United States Patent [19]

Hinchcliffe et al.

[11] 4,245,934

[45] Jan. 20, 1981

[54] CONVEYING ROD-LIKE ARTICLES

[75] Inventors: Dennis Hinchcliffe; George R. Bennett, both of London, England

[73] Assignee: Molins Limited, Great Britain

[21] Appl. No.: 28,888

[22] Filed: Apr. 10, 1979

[30] Foreign Application Priority Data

Apr. 14, 1978 [GB] United Kingdom ..... 14720/78

[51] Int. Cl.[3] ..... B65G 51/04

[52] U.S. Cl. ..... 406/62; 131/20 R; 406/74; 406/147; 406/186

[58] Field of Search ..... 406/52, 63, 68, 74, 406/110–112, 147–150, 184–190, 197, 198; 131/20 R, 25; 53/236

[56] References Cited

U.S. PATENT DOCUMENTS

| | | | |
|---|---|---|---|
| 887,608 | 5/1908 | Duflon | 406/74 X |
| 1,964,167 | 6/1934 | Needham | 406/194 X |
| 3,189,297 | 6/1965 | Ellithorpe | 406/186 X |
| 3,490,717 | 1/1970 | Resler | 406/147 X |

FOREIGN PATENT DOCUMENTS

| | | | |
|---|---|---|---|
| 635900 | 11/1935 | Fed. Rep. of Germany | 406/184 |

*Primary Examiner*—Jeffrey V. Nase
*Attorney, Agent, or Firm*—Craig & Antonelli

[57] ABSTRACT

Rod-like articles such as cigarettes are conveyed in a pneumatic carrier tube in a capsule in order to prevent degradation during conveyance. The capsule may include a support portion having an opening through which the cigarette is received, and a guide portion in the form of a flange. The carrier tube may lead to remote test equipment for the cigarettes. The capsule is preferably pneumatically shuttled between a delivery station and the test equipment in order to convey successive cigarettes randomly selected from a stream of cigarettes passing, for example, from a filter cigarette making machine.

26 Claims, 11 Drawing Figures

CONVEYING ROD-LIKE ARTICLES

This invention relates to a method and apparatus for the pneumatic transport of rod-like articles.

In the cigarette industry it is common to monitor the quality of cigarettes produced by a cigarette-making machine. Such machines are often associated with inspection equipment for this purpose, which equipment detects and ejects faulty cigarettes. Since the equipment usually inspects every cigarette produced by the machine the inspection is necessarily of short duration and cannot detect all the possible defects in a cigarette. Consequently, it is desirable to pass individual cigarettes, usually selected at random, to further inspection or measuring equipment (e.g. for more detailed testing or measurement). It is convenient to arrange for such further equipment to accept cigarettes from a number of producing machines, and the equipment is therefore likely to be remote from at least some of the machines. The present invention is particularly, but not exclusively, concerned with a method and apparatus capable of conveying individual cigarettes to such further equipment.

It is already known to convey rod-like articles pneumatically along a carrier tube. For example, cigarette filter rods may be conveyed pneumatically from a distribution unit to a plurality of filter cigarette making machines connected to the unit by pneumatic conduits. Cigarette filter rods are more robust than cigarettes and, especially where subsequent test or measurement is to be carried out on a cigarette, it is important that cigarettes are not damaged or degraded while being conveyed.

According to one aspect of the present invention a method of conveying rod-like articles includes the steps of inserting the article into a capsule, comprising a support for the article and a portion adapted to guide the capsule through a carrier tube, and pneumatically conveying the capsule containing the article through the tube. After arrival at a receiving station the article may be removed from the capsule and the capsule returned pneumatically through the carrier tube to receive another article.

Another aspect of the invention provides a conveying system for rod-like articles, comprising a delivery station, a receiving station, a carrier tube extending from the delivery station to the receiving station, a capsule adapted to receive at least one rod-like article at the delivery station, and means for pneumatically conveying the capsule from the delivery station to the receiving station along the carrier tube. The system may include means for returning the capsule to the delivery station along the carrier tube.

The support is preferably a cylindrical or part-cylindrical container or suitable size for holding the article fairly closely. The article may be introduced into the support axially or transversely. Where the article is inserted axially, the support preferably has a removable closure at one end. For transverse insertion the support has an opening along one side, which may be closable. Alternatively, the opening could be effectively closed by the carrier tube itself, to retain the article in the support during conveyance.

The guide portion is preferably so dimensioned that it extends to fill a substantial proportion of the cross-sectional area of the carrier tube, thereby allowing effective action of air pressure in the tube on the capsule.

Preferably the guide portion extends beyond the periphery of the support to closely correspond in external dimensions to the internal dimensions of the tube, but allowing sufficient clearance for rapid movement of the capsule in the tube. When it is desired to use relatively long lengths of carrier tube and/or transport several capsules in the tube simultaneously, it may be necessary to provide sufficient clearance between the tube and the guide portions (possibly by means of recessed channels in the tube) and/or to provide air pressure inlets spaced along the tube, so as to ensure sufficient air pressure to convey the capsules throughout the length of the tube.

Preferably the guide portion extends along the length of the capsule for a short distance relative to that length. The guide portion could be at one end of the capsule and may comprise a flange attached to the support. Conveniently, the carrier tube and guide portion are rectangular.

By having a relatively short guide portion which extends almost to the sides of the carrier tube, it is possible to use a tube of somewhat larger cross-sectional area than the article being conveyed and still retain effective transfer, due to the piston-like action of the guide in the tube. The larger cross-sectional area of the tube allows smaller radius longitudinal curves in the tube, having regard to the relatively long articles which it may be desired to convey. This can be an advantage where space for mounting the carrier tube is limited.

The conveying system of the invention may include a delivery station comprising support means for holding a capsule in a first position, means for conveying a rod-like article towards said first position for transfer into the capsule, and means for moving the support means from the first position to a second position in which the capsule is aligned with the end of a carrier tube, whereby the capsule may be introduced into the carrier tube for pneumatic conveyance along the tube.

The means for conveying a rod-like article may include a fluted drum or endless band conveyor for moving the article in a direction transverse to its length. Suction means could be used to aid or effect transfer to the capsule. Such suction means could be supplied through the support means to and through the capsule (having an air permeable portion for this purpose). The support means may be pivoted to move between said first and second positions. For example, the capsule could be supported in said first position above a stack of rod-like articles moving on a band conveyor, so that an article in the stream is lifted into the capsule and the support means subsequently pivoted upwards through about 90° to deliver the capsule into an adjacent substantially vertical carrier tube.

A capsule may contain two or more rod-like articles, either axially or transversely disposed.

The invention will be further described, by way of example only, with reference to the accompanying diagrammatic drawings, in which.

Figure 1:
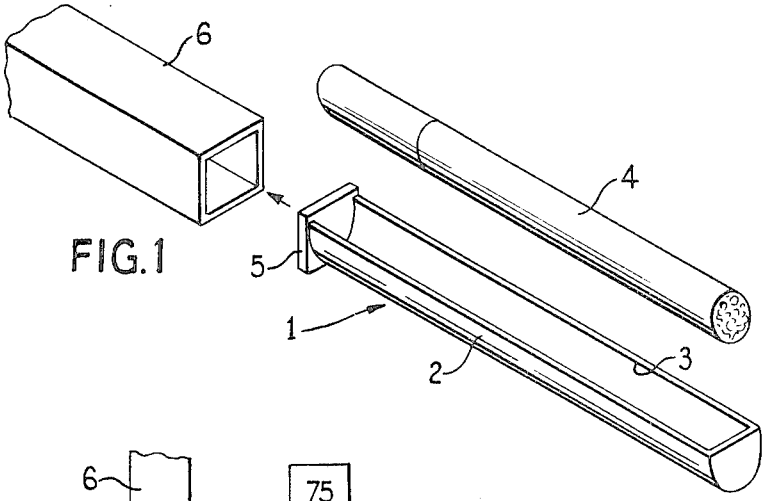
FIG. 1 is a perspective view of a cigarette, capsule and carrier tube.

Referring to FIG. 1, a capsule 1 for receiving a cigarette comprises a support in the form of a part-cylindrical portion 2 having an opening 3 along one side through which a filter cigarette 4 may be passed transversely into the capsule. Both ends of the portion 2 are closed and one end carries a guide portion comprising a rectangular flange 5 which has dimensions slightly smaller than the internal dimensions of a carrier tube 6. The capsule 1 is thus adapted to receive a filter cigarette 4 and convey it through the carrier tube 6. The capsule 1 is preferably constituted of relatively light plastics material. The fairly close fit of the flange 5 allows air pressure in the carrier tube 6 to convey the capsule 1 effectively, with the rather lesser dimensions of the portion 2 allowing the capsule to pass around curves in the carrier tube. Since the cigarette 4 is retained in the capsule 1 by the carrier tube 6, the orientation of the capsule 1 while it is in the tube may vary. For example, the capsule 2 may initially be positioned with the opening 3 uppermost so that the cigarette 4 may be dropped into the capsule, as indicated in FIG. 1. Subsequently, the capsule 1 may be twisted about its longitudinal axis as it passes through the tube 6, or the tube may follow a particular path such that when the capsule reaches the end of the tube the opening 3 is directed downwards and the cigarette 4 falls out (e.g. at an inspection position).

Figure 2:
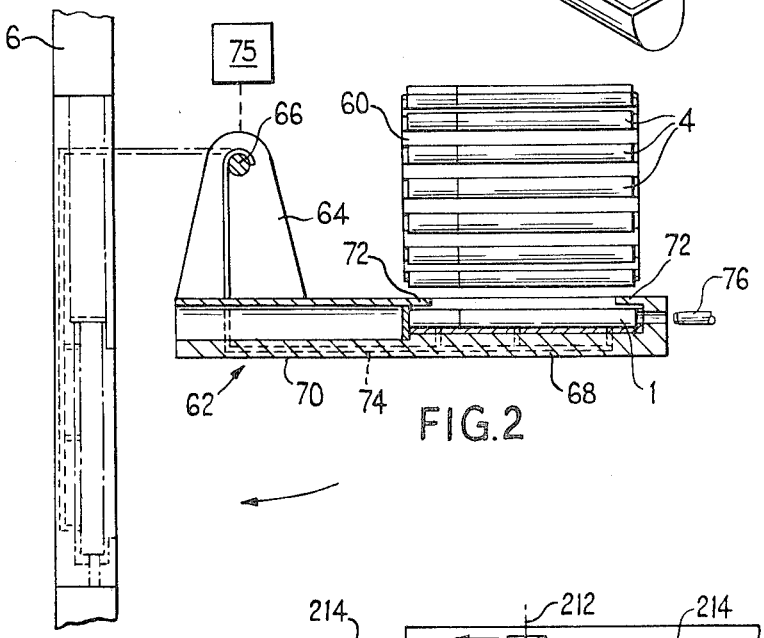
FIG. 2 shows one form of apparatus for delivering cigarettes into capsules for conveyance along a carrier tube.

Apparatus suitable for inserting cigarettes 4 into the capsule 1, and for introducing the capsule into the carrier tube 6, is shown in FIG. 2. Cigarettes 4 are conveyed transversely on a fluted drum 60 to a position adjacent a support member 62 pivotally mounted by means of brackets 64 about a horizontal axis 66. The member 62 includes a first part 68 adapted to hold a capsule 1 adjacent the drum 60 to receive a cigarette 4, and a second part 70 comprising a rectangular tube. The capsule 1 is held in the part 68 by means including flanges 72 and may be inserted through the part 70 (or from the other end of the member 62) or transversely.

The drum 60 may be rotatable intermittently and may cooperate with stationary guides (not shown) or may be provided with suction, so that cigarettes 4 are maintained in the flutes of the drum until they are positioned for transfer into a capsule 1 held by the member 62. After transfer to the capsule, the cigarettes 4 may be retained in the capsule by suction means including a conduit 74 in the member 62 communicating with the capsule 1, the portion 2 including air-permeable sections as indicated in FIG. 2, for this purpose. Alternatively, after a cigarette 4 is received in the capsule 1, the latter may be moved axially into the part 70 of the member 62 so that this part then retains the cigarette in the capsule. Pressure air supplied by a stationary nozzle 76 adjacent the outer end of the support member 62 could be used to move the capsule into the part 70.

When the capsule 1 in the support member 62 has received a cigarette 4, the member 62 is pivoted about its axis 66 to move the part 70 into abutment with the end of a vertical carrier tube 6. Reversible drive means 75 for performing this movement, which drive means also holds the member 62 in either of the positions shown in FIG. 2, is indicated diagrammatically in FIG. 2. Subsequently, suction in the tube 6 (or pressure air introduced behind the capsule 1 through the member 62) moves the capsule into the tube 6 for conveyance through the tube. The capsule 1 could be introduced into and conveyed through the tube 6 by means of an ejector head similar to the ejector 46 described below with reference to FIG. 9.

Figure 3:
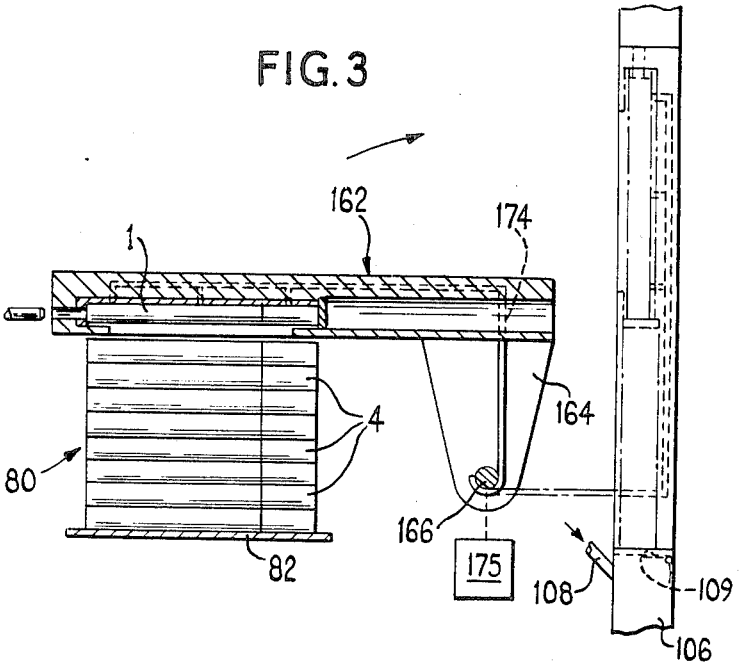
FIG. 3 shows a modified form of the apparatus of FIG. 2.

The cigarettes 4 conveyed on the fluted drum 60 may be sampled from a stream of cigarettes and delivered to the drum by means of apparatus as described below with reference to FIGS. 8 to 10. Alternatively, the apparatus of FIG. 2 may be modified to sample cigarettes directly from a stream. Such apparatus is shown in FIG. 3. Referring to this Figure, a stream 80 of cigarettes 4 in stack formation is conveyed on a band conveyor 82. A support 162, similar to the support 62 in FIG. 2, is arranged to hold a capsule 1 above the stream 80 and is carried by brackets 164 pivoted about an axis 166. Individual cigarettes 4 are lifted from the top of the stream into the capsule 1 by means of suction applied through a conduit 174. Drive means 175 similar to the drive means 75 then rotates the support member 162 into the position shown in chain-dot lines in FIG. 3, so that the capsule 1 may be introduced into the carrier tube 106. Since the support member 162 is vertically above the carrier tube 106, the capsule 1 may pass into the tube 106 by gravity and subsequently be conveyed through the tube by pressure air introduced as by a nozzle 108. The entrance to the carrier tube 106 (and to the tube 6) could be provided with a simple form of one-way flap valve, as indicated at 109, which allows the capsule 1 to pass but which maintains substantial pressure in the tube 106. The support member 162 (or 62) could operate a valve at the entrance to the carrier tube 106 (or 6).

Figure 4:
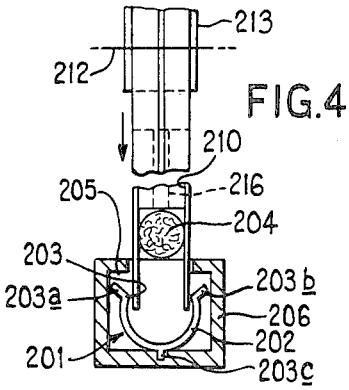
FIG. 4 is a sectional view showing insertion of a cigarette into a modified capsule.
Figure 5:
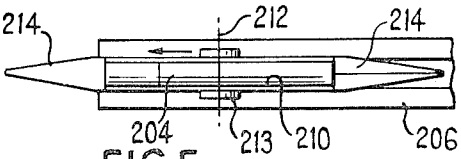
FIG. 5 is a plan view of the apparatus of FIG. 4.
Figure 6:
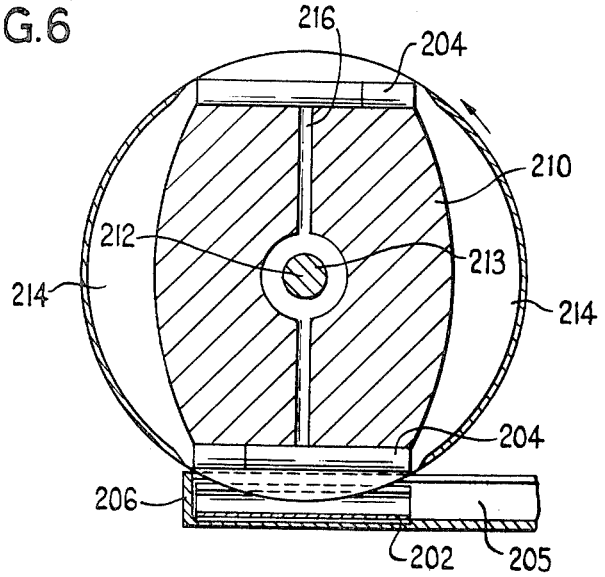
FIG. 6 is a side view of the apparatus of FIG. 4.

Referring now to FIGS. 4 to 6, a carrier tube 206 adapted for use with a capsule 201 having a modified part-cylindrical portion 202 is shown. The capsule 201 also includes a rectangular flange 205 connected to the portion 202. The portion 202 is of flexible resilient plastics material having a longitudinal opening 203 through which a cigarette 204 may be inserted transversely into the capsule. The natural resilience of the portion 202 is such that in its unstrained form the opening 203 is sufficiently narrow to retain the cigarette 204 in the capsule 201. Consequently, in order to introduce the cigarette into the capsule portion 202, it is necessary to widen the opening 203. This is achieved by means of a carrier wheel 210.

The wheel 210, which is rotatable about an axis 212 and driven by a coaxial drive shaft 213 is adapted to carry two cigarettes 204 in spaced positions in which the cigarettes are arranged with their axes transverse to the axis 212. The wheel 210 also includes tapered sections 214 adapted to enter between lugs 203*a* and 203*b* on the portion 202 and, as the wheel is rotated, gradually widen the opening 203 to receive the cigarette 204. The cigarettes may be retained in position on the wheel 210 until the correct position for transfer has been reached by means of suction supplied through a conduit 216. After insertion, further rotation of the wheel 210 causes the tapered part of the wheel to pass between the lugs 203*a*, 203*b* thus allowing the portion 202 to resume its unstressed position and enclose the cigarette 204. At this position the capsule including portion 202 may be conveyed along the tube 206. When the next capsule is placed in the tube 206 the wheel 210 is further rotated so that the tapered section 214 widens the opening 203 to receive the next cigarette 204. Cigarettes 204 are preferably introduced onto the wheel 210 at a position opposite the position of transfer into a capsule 201. It should be noted that the portion 202 includes a further guide lug 203*c* adapted to be received in a corresponding groove in the tube 206.

Figure 7:
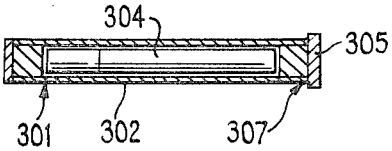
FIG. 7 is a sectional view of another form of cigarette capsule.

FIG. 7 shows a modified capsule 301 adapted to receive a cigarette 304 in a cylindrical portion 302 through an open end which is subsequently closed by a plug 307 incorporating a rectangular flange 305.

Figure 8:
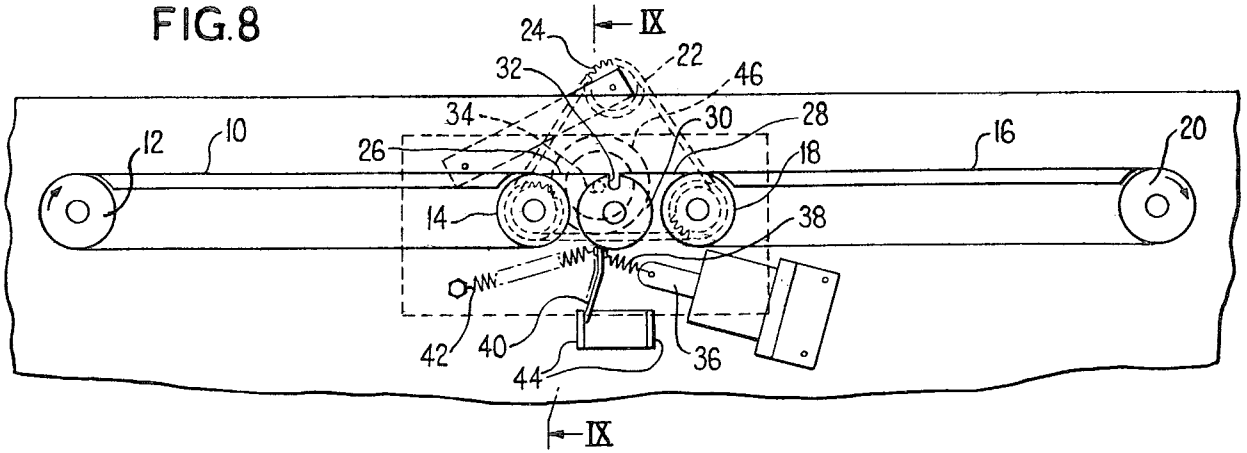
FIG. 8 is a side view of apparatus for conveying a stream of cigarettes, including a device for sampling cigarettes from the stream.
Figure 9:
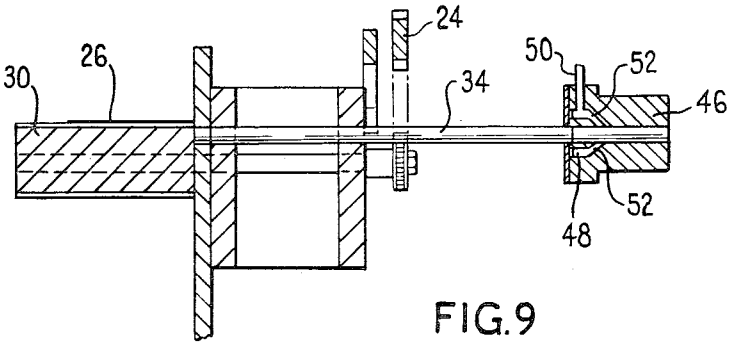
FIG. 9 is a sectional view on the line IX—IX of FIG. 8.
Figure 10:
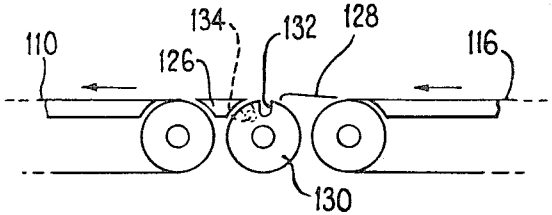
FIG. 10 is a side view of part of a modification of the apparatus of FIG. 8.

Apparatus suitable for introducing a cigarette into a capsule in an axial direction is shown in FIGS. 8, 9 and 10. The apparatus is substantially the same as that described and illustrated in co-pending British Patent Application No. 52474/76.

FIGS. 8 and 9 show a first endless band conveyor 10 passing around pulleys 12 and 14, and an aligned second endless band conveyor 16 passing around pulleys 18 and 20. The adjacent pulleys 14 and 18 are driven by means of a chain 22 passing around a drive gear 24. The space between the upper runs of conveyors 10 and 16 contains first and second stationary dead plates 26, 28, each having a polished or other low-friction surface. The plates 26 and 28 are separated by a parallel-sided gap having a width slightly greater than the diameter of a rod-like article to be conveyed by the apparatus. Directly underneath this gap is a drum 30 provided with an axial slot 32 having a width and length sufficient to receive a rod-like article from the gap.

When a stream consisting of a multi-layer stack of cigarettes moving transverse to their lengths is conveyed by the conveyors 10 and 16, one cigarette will fall through the gap and be received in the slot 32, where it will remain, effectively blocking the gap, so that other cigarettes of the stream subsequently pass relatively smoothly over the plates 26, 28 and gap.

The drum 30 is rotatable from the position in which the slot 32 is underneath the gap between plates 26, 28 to a position in which the slot is aligned with th end of a tube 34. Rotation of the drum 30 between these positions is controlled by a solenoid-operated plunger 36 connected by a spring 38 to an arm 40 fixed to the drum. The plunger 36 acts on the arm 40 against a further spring 42, and fixed stops 44 are provided for the arm to limit rotation of the drum 30.

The tube 34 leads to an ejector head 46 which includes an annular manifold 48 connected to a pneumatic supply pipe 50 and angled bores 52 leading from the manifold into the tube. When the drum 30 is positioned so that the slot 32 is aligned with the end of the tube 34, air under pressure is admitted to the manifold 48 from the pipe 50. The resultant flow of air down the inclined bores 52 and out of the right-hand end of the tube 34 (as viewed in FIG. 8) produces a suction effect in the tube between the ejector head 46 and the drum 30 and this effect is sufficient to draw a cigarette from the slot 32 into and through the tube. The cigarette is subsequently ejected from the tube, normally under the direct action of pressure air from the bores 52. Alternatively, it would be possible to rely entirely on the suction effect to accelerate the cigarette to a velocity such that it would be ejected from the tube even when the supply of air to the head 46 to shut off before the cigarette reaches the head. The ejected cigarette may be received directly in the capsule of FIG. 7.

While the slot 32 is aligned with the tube 34, the surface of the drum 30 blocks the gap between the plates 26 and 28. On release of the solenoid-operated plunger 36 the drum 30 returns to its position with the slot 32 beneath this gap and the slot is almost immediately occupied again by a cigarette falling through the gap from the stream above.

The solenoid can be operated at random or at automatically-timed intervals to select a proportion of cigarettes from the stream. The arm 40 can be operated manually instead of by means of the solenoid. Since removal of a cigarette from the slot 32 is rapid once the slot is aligned with the tube 34 it is necessary to rotate the drum 30 only so that the slot is momentarily aligned and it can then be released to return to its original position. Actuation of the solenoid (or rotation of the drum 30) can be arranged to simultaneously connect pressure air to the supply pipe 50. It would be possible to use a direct source instead of relying on the suction effect created by the ejector head 46. Alternatively, air under pressure could be used to blow a cigarette from the slot 32 and along the tube 34. The air supplied through the pipe 50 is typically of a pressure in the range 0.25 to 10.0 p.s.i., and is largely dependent on the distance through which the cigarette is to be moved.

The conveying apparatus of FIGS. 8 and 9 is positioned as part of a conveying system for a stream of cigarettes. The system, for example, could be for moving cigarettes away from a cigarette making machine and towards a packing machine. The apparatus provides a facility for removing cigarettes from a stream and introducing them into a capsule for subsequent conveyance (over a longer distance) to inspection and/or test equipment.

A slightly modified arrangement is shown in FIG. 10, where a stack of cigarettes passes over polished plates 128, 126 between conveyors 116, 110, the plates defining a gap over a drum 130 having a slot 132. One plate 128 is provided with a ramp and the other plate 126 has a flat surface similar to the plate 26. The ramp of plate 128 disturbs the flow of cigarettes so that "bridging" over the gap between the plates is discouraged. (If bridging does occur there is a tendency for cigarettes to become misaligned as one end falls through the gap and so cause an obstruction.) The plate 126 includes a curved portion which lies close to the periphery of drum 130, thereby forming a shroud for the slot 132 when it is in alignment with a delivery tube 134: this increases the effect of suction applied through the tube 134. In other respects the apparatus of FIG. 10 is similar to that of FIGS. 8 and 9 and may be used in a similar way.

Where the present invention is used for transport of cigarettes to inspection equipment it is convenient to use a single capsule for conveyance of each successive cigarette. This is achieved by return of the empty capsule from the inspection equipment, preferably by reverse conveyance along the carrier tube itself. This avoids a requirement for a relatively large store of capsules and/or a separate return path. The capsule may be returned by reverse air pressure in the tube and may be received in a member such as the support member 62 or 162 for movement to the position at which the cigarette is received. Thus the capsule may be arranged to "shuttle" or reciprocate between the cigarette supply (usually a stream) and the inspection equipment. Each of the illustrated embodiments could be operated in this way. The carrier tube could be branched at one or both ends so that several capsules could be used, but this would normally involve provision of directional control for the capsules in the tube.

Figure 11:
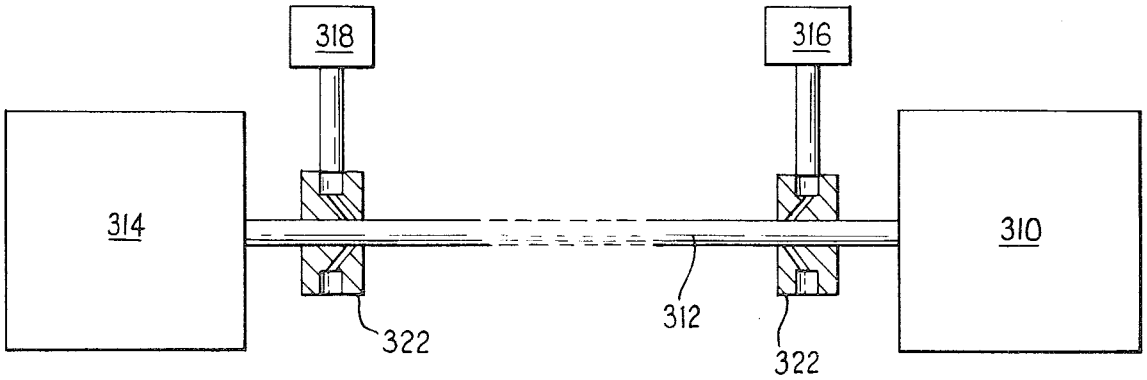
FIG. 11 is a schematic view of a pneumatic conveying system for a capsule.

FIG. 11 schematically shows a typical pneumatic capsule conveying system. One or more rod-like articles are introduced into a capsule at a delivery station 310 for conveyance along a pneumatic carrier tube 312. The station 310 may be substantially as described with reference to FIGS. 2, 3, or 4. The carrier tube 312 leads to a receiving station 314 which may incorporate test equipment for the articles. The system includes means 316 (which may include an air pump) for producing an air flow along the tube 312 to convey full capsules to the receiving station 314, and also similar means 318 for producing a reverse air flow to return empty capsules along the tube to the delivery station 310. The means 316 and 318 include air pressure heads 320, 322 respectively, which may be similar to the head 46 described with reference to FIG. 9.

We claim:

1. A method of conveying rod-like articles including the steps of conveying the articles in a stream in a direction transverse to their lengths, separating at least one article from the stream and conveying it at least partly by use of an air stream into a capsule which comprises a support for the article and a portion adapted to guide the capsule through a carrier tube, and pneumatically conveying the capsule containing the article through the carrier tube.

2. A method as claimed in claim 1, including the further steps of removing the article from the capsule after conveyance through the carrier tube, and returning the empty capsule pneumatically through the carrier tube to receive another article.

3. A method as claimed in claim 1, wherein said at least one article is conveyed pneumatically in an axial direction into said capsule.

4. A method as claimed in claim 1, wherein suction is applied to the capsule to aid transfer of an article into the capsule.

5. A conveying system for rod-like articles, comprising a delivery station, a receiving station, a carrier tube extending from the delivery station to the receiving station, a capsule adapted to receive at least one rod-like article at the delivery station, means for pneumatically transferring an article into the capsule at the delivery station, and means for pneumatically conveying the capsule from the delivery station to the receiving station along the carrier tube.

6. A system as claimed in claim 5, including means for returning the capsule to the delivery station along the carrier tube.

7. A system as claimed in claim 5, wherein the capsule comprises a support for the rod-like article and a portion adapted to guide the capsule in the carrier tube.

8. A system as claimed in claim 7, wherein said guide portion extends along the length of the capsule for a short distance relative to said length.

9. A system as claimed in claim 8, wherein the guide portion consists of a flange at one end of the capsule.

10. A system as claimed in claim 5, wherein the delivery station and capsule are arranged so that an article is inserted into the capsule in an axial direction.

11. A system as claimed in claim 5, wherein the delivery station and capsule are arranged so that an article is inserted into the capsule in a direction transverse to its length.

12. A system as claimed in claim 11, wherein the delivery station includes support means for holding a capsule in a first position, means for conveying a rod-like article towards said first position for transfer into the capsule, and means for moving the support means between the first position and a second position at which the capsule may be introduced into the carrier tube.

13. A system as claimed in claim 12, wherein said conveying means is arranged to convey a stream of articles in a direction transverse to the lengths of the articles.

14. A system as claimed in claim 12, wherein the support means is movable between said first and second positions by rotation about an axis transverse to a capsule held by said support means.

15. A system as claimed in claim 14, wherein the support means is arranged so that a capsule is held substantially horizontal in said first position and substantially vertical in said second position.

16. A system as claimed in claim 11, wherein the capsule is provided with at least one flexible wall adjacent an opening through which an article is received.

17. A system as claimed in claim 16, further including means at said delivery station for flexing said flexible wall to increase the size of said opening to permit passage of an article therethrough and into said capsule.

18. A system as claimed in claim 5, wherein said pneumatic transferring means comprises suction means.

19. A conveying system for rod-like articles, comprising a delivery station, a receiving station, a carrier tube extending from the delivery station to the receiving station, a capsule adapted to receive at least one rod-like article to the delivery station, said capsule comprising a support for the rod-like article and a portion adapted to guide the capsule in the carrier tube, the support including an air-permeable wall to allow retention of an article in the capsule by suction, and means for pneumatically conveying the capsule from the delivery station to the receiving station along the carrier tube.

20. A conveying system for rod-like articles, comprising a delivery station, a receiving station, a carrier tube extending from the delivery station to the receiving station, a capsule adapted to receive at least one rod-like article at the delivery station, the delivery station and capsule being arranged so that the article is inserted into the capsule in a direction transverse to its length, and means for pneumatically conveying the capsule from the delivery station to the receiving station along the carrier tube, wherein the capsule is provided with at least one flexible wall adjacent an opening through which an article is received and wherein the delivery station includes a rotatable member adapted to engage said flexible wall and enlarge said opening prior to transfer of an article into said capsule.

21. A system as claimed in claim 20, where an article to be transferred into said capsule is carried to a transfer position by said rotatable member.

22. A conveying system for cigarettes comprising means for conveying a stream of cigarettes between a cigarette making machine and a cigarette packing machine, a receiving station for cigarettes in said stream, said receiving station including a cigarette inspection position, a delivery station associated with said conveyor means, a carrier tube extending between said delivery station and said receiving station, said carrier tube including at least one capsule adapted to receive at least one cigarette, means for delivering a cigarette from said stream into a capsule at said delivery station, means for pneumatically conveying said capsule containing at least one cigarette along said carrier tube from said delivery station to said receiving station, and means for returning the capsule to the delivery station to receive another cigarette from said stream.

23. A system as claimed in claim 22, including pneumatic means for delivering a cigarette into said capsule.

24. In a system for conveying a stream of cigarettes between one or more cigarette makers and one or more cigarette packers, means for removing individual cigarettes at relatively infrequent intervals for conveyance to a receiving station which incorporates a cigarette inspection position, said means comprising a carrier tube and at least one capsule adapted to receive a cigarette from said stream, and pneumatic means for shuttling said capsule between said stream and said receiving station so that cigarettes may be conveyed to said station by said capsule and said capsule returned to said stream empty to receive another cigarette.

25. A conveying system for rod-like articles, comprising a delivery station, a receiving station, a carrier tube extending from the delivery station to the receiving station, a capsule adapted to receive at least one rod-like article at the delivery station, and means for pneumatically conveying the capsule from the delivery station to the receiving station along the carrier tube, wherein the capsule comprises a guide portion for engaging the carrier tube, and a support portion for holding the articles, the support portion being narrower than the guide portion and the guide portion being short relative to the length of the capsule, so that the capsule is able to twist to some extent in the carrier tube and is thereby adapted to pass around bends in the carrier tube.

26. A conveying system for rod-like articles comprising a delivery station; a receiving station; a carrier tube extending from the delivery station to the receiving station; a capsule adapted to receive at least one rod-like article at the delivery station; the delivery station including support means for holding a capsule in a first position, means for conveying a stream of articles towards said first position in a direction transverse to the lengths of the articles for transfer of articles into the capsule in a direction transverse to the length of the articles, the support means being provided with suction means to aid said transfer of articles, and means for moving the support means between the first position and a second position at which the capsule may be introduced into the carrier tube; and means for pneumatically conveying the capsule from the delivery station to the receiving station along the carrier tube.

* * * * *